United States Patent [19]

Simjian et al.

[11] Patent Number: 5,040,313

[45] Date of Patent: Aug. 20, 1991

[54] ATHLETIC SHOE WITH IMPACT SENSING MEANS

[76] Inventors: Luther G. Simjian, 1750 S. Ocean La., Fort Lauderdale, Fla. 33316; Maryjo S. Garre, 32 Brinker Rd., Barrington, Ill. 60010

[21] Appl. No.: 472,224

[22] Filed: Jan. 30, 1990

[51] Int. Cl.[5] ..... A43B 5/00

[52] U.S. Cl. ..... 36/114; 36/44

[58] Field of Search ..... 36/114, 44, 139, 28; 128/694, 155, 169, 783, 782, 779, 156, 165; 73/172

[56] References Cited

U.S. PATENT DOCUMENTS

| | | | |
|---|---|---|---|
| 3,702,999 | 11/1972 | Gradisar | 36/139 |
| 3,791,375 | 2/1974 | Pfeiffer | 128/779 |
| 4,421,124 | 12/1983 | Marshall | 128/782 |
| 4,503,705 | 3/1985 | Porchaninoff | 73/172 |
| 4,574,812 | 3/1986 | Arkans | 128/694 |
| 4,745,930 | 5/1988 | Confer | 128/779 |
| 4,747,415 | 5/1988 | Lavoisier | 128/694 |
| 4,768,295 | 9/1988 | Ito | 36/28 |
| 4,776,331 | 10/1988 | Simjian | 128/155 |
| 4,814,661 | 3/1989 | Ratzlaff et al. | 73/172 |
| 4,858,620 | 8/1989 | Sugarman et al. | 73/172 |

FOREIGN PATENT DOCUMENTS

| | | | |
|---|---|---|---|
| 3743835 | 4/1989 | Fed. Rep. of Germany | 128/779 |

*Primary Examiner*—Steven N. Meyers

[57] ABSTRACT

An athletic shoe includes impact sensing means disposed in contact with the impact cushioning material disposed between the inner sole and the outer sole of the shoe. The impact sensing means comprises a rupturable material having encapsulated dye. If the impact pressure effective upon the medium exceeds a predetermined value, the medium ruptures, releasing the dye for providing a visual indication that the impact pressure exceeded a predetermined value. A plurality of strips of rupturable material can be provided, each rupturing at a different pressure and each having dye of a respectively different color.

2 Claims, 1 Drawing Sheet

ATHLETIC SHOE WITH IMPACT SENSING MEANS

BACKGROUND OF THE INVENTION

In U.S. Pat. No. 4,776,331 entitled "Bandage," dated Oct. 11, 1988, there has been disclosed a bandage which includes pressure responsive means for providing an indication when the bandage applied to a part of a human body is too tight, causing pain. The pressure responsive means comprises a medium in sheet or strip from having encapsulated fluid, liquid or gas. The medium ruptures when a predetermined pressure is exceeded, thereby releasing the fluid. When the fluid comprises a liquid dye, the staining of the bandage provides a visual indication that a condition of excessive pressure is present.

It is now disclosed to use substantially the same pressure responsive means in connection with athletic shoes to indicate when the condition of excessive impact force is experienced by the wearer of the shoe. It is well known that runners and joggers experience very high impact forces on their feet and that such condition can lead to severe, sometimes permanent, bodily injury. In order to avoid this condition, athletic shoes include significant cushioning material between the inner sole and the outer sole for reducing the impact shock. Such cushioning material may comprise several layers of rubberized material, air cushions, gel material, etc.

The present invention discloses an arrangement wherein a strip of a rupturable medium containing dye in an encapsulated form is disposed in contact with the cushioning material, for instance at the location of the heel. When the impact force effective upon the rupturable medium exceeds a predetermined value, the medium ruptures and the escaping dye will stain the inner sole or, for instance, the sock of the person wearing the shoe. Therefore, a jogger or runner can be warned that the shoe has insufficient cushioning material, or that the cushioning material no longer is effective, having reached the end of its useful life. It will be apparent that a shoe construction of this type has significant benefits to joggers, runners, and sprinters, warning them of potential harm prior to actual and permanent injury.

One of the principal objects of this invention, therefore, is the provision of a new and improved athletic shoe construction.

Another important object of this invention is the provision of an athletic shoe construction having an impact sensing means in contact with the cushioning material normally provided in the shoe.

Another important object of this invention is the provision of an athletic shoe construction having an impact sensing means disposed in the shoe, the sensing means comprising a rupturable medium containing dye in an encapsulated form, said dye being released when a predetermined pressure acting thereupon is exceeded.

A further and important object of this invention is the provision of an athletic shoe having an impact sensing means comprising liquid dye in an encapsulated form, the dye being released when a predetermined pressure acting upon the sensing means is exceeded.

A still further object of this invention is the provision of an athletic shoe construction having impact sensing means in the form of strips of a rupturable medium, each strip containing dye of a different color and each strip being rupturable at a different predetermined impact force acting thereupon.

Further and still other objects of this invention will be more readily apparent from the following description when taken in conjunction with the accompanying drawings.

Figure 1:
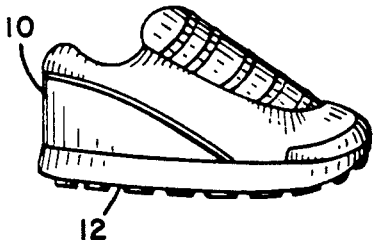
FIG. 1 is a view at a typical athletic shoe.

Referring no to the figures and FIG. 1 in particular, there is shown a typical athletic show 10 as may be used for jogging, running, etc. The shoe has an inner sole, not visible in FIG. 1, engaged normally by the foot of the wearer, and an outer sole 12 normally contacting the road.

Figure 2:
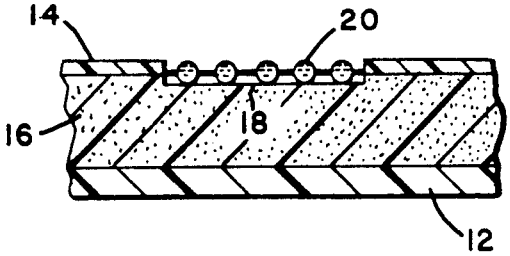
FIG. 2 is a sectional view showing the impact cushioning material and impact sensing means.
Figure 3:
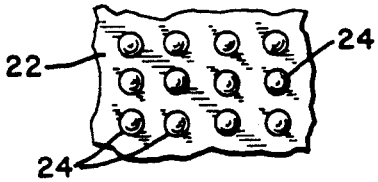
FIG. 3 is a plan view of an impact sensing means comprising a strip with encapsulated dye.
Figure 4:
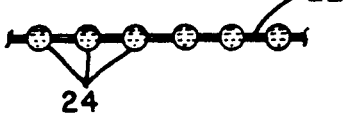
FIG. 4 is an elevational view of the strip with encapsulated dye.

As seen in FIG. 2, the inner surface or sole 14 and the outer sole 12 are separated by suitable impact cushioning material 16. The cushioning material may comprise various materials, such as rubberized foam, air cushions, gel, etc. and combinations thereof. A pocket 18 is provided in the cushioning material near the inner sole 14 and the pocket is provided with an impact sensing means 20. In the present embodiment, the sensing means 20 comprises a medium 22, FIGS. 3 and 4, suitable plastic sheeting, having localized areas of encapsulated dye 24 in liquid, semi-liquid or dry form. Sheets of this type are well known, see patent supra, and may be cut to strip form. The plastic sheeting is of such thickness and character as to rupture when a predetermined impact pressure effective thereupon is exceeded, causing then the encapsulated dye to become released from one or more of the areas of encapsulation.

As seen in FIG. 2, if the foot of the wearer impacts upon the strip with encapsulated dye with a pressure sufficient to cause rupture thereof, the encapsulated dye is released to stain the inner sole, the cushioning material and/or the sock of the wearer of the shoe. Thus, a warning is provided that the impact pressure is greater than desired or considered safe for the runner. Since the impact pressure generally is greatest at the heel area, it is considered good practice to place the rupturable medium 22 at or near the heel area of the shoe.

Figure 5:
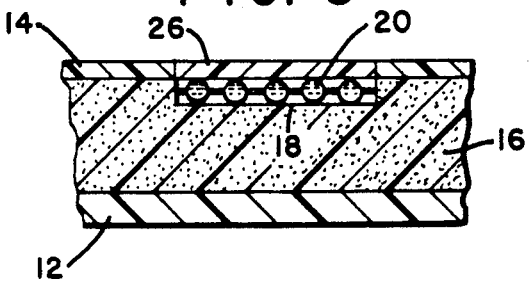
FIG. 5 is a sectional view of an alternative embodiment of the invention.

FIG. 5 shows an alternative embodiment. The inner sole 14 at the area of the pocket or recess 20 is provided with a transparent cover 26 so that the dye, when released, is confined to the pocket, but is visible through the cover 26. Alternatively, the cover 26 may be made from a material which is readily stained by the dye, or the inner sole which normally is dyed, can be left without dye at the area which covers the rupturable medium.

Figure 6:
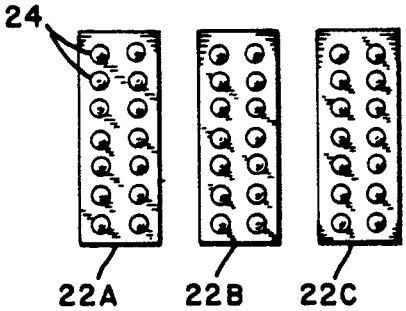
FIG. 6 is a plan view of a plurality of strips, each having encapsulated dye, but each strip being rupturable at a respectively different pressure.
Figure 7:
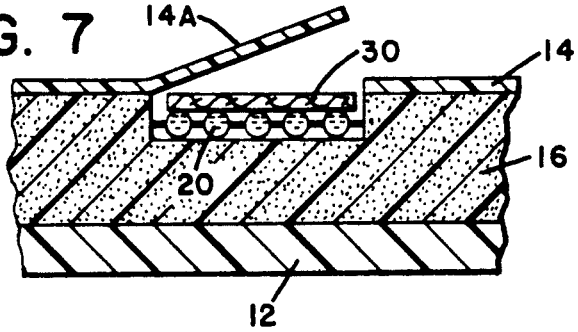
FIG. 7 depicts a further alternative embodiment.

In a further alternative embodiment seen in FIG. 6, a plurality of strips 22A, 22B and 22C are provided in the shoe. Each of the strips is made to rupture at a different specific impact pressure so that medium 22A will rupture upon exceeding pressure P1, medium 22B upon exceeding pressure P2, and medium 22C upon exceeding pressure P3. If each of the strips contains dye of a different color, e.g., red, green, and black, the severity of the impact pressure is discernible. Still another alternative embodiment shown in FIG. 7 depicts the inner sole 14 provided with a liftable tab or cover 14A. A dye absorbing pad 30, for instance, white cotton material, is superposed on the impact sensing means 20. If dye is released from the encapsulated locations, the pad 30 will be stained and such staining will become visible either through the tab 14A, if it is transparent, or by lifting the tab 14A, if the tab is opaque. The construction shown in FIG. 7 enables the sensing means 20 and the pad 30 to be replaced if dye has been released, or the use of selected sensing means rupturing at different predetermined pressures as described heretofore.

It will be apparent therefore, that the impact sensing means disclosed above provides an important safeguard to runners and joggers, indicating when the impact pressure reaches undesirable high values. The jogger has then the option to change the shoes or modify his running.

While there has been described and illustrated a preferred embodiment of the invention and several alternative embodiments have been shown, it will be apparent to those skilled in the art that various further changes and modifications may be made without departing from the broad principle of this invention, which shall be limited only by the scope of the appended claims.

What is claimed is:

1. An athletic shoe having an inner sole, an outer sole and shock absorbing cushioning material disposed between said soles, the improvement comprising:

a rupturable medium containing dye in an encapsulated form disposed in contact with said cushioning material, said medium being rupturable responsive to pressure acting thereupon exceeding a predetermined value, thereby causing encapsulated dye to be released;

a dye absorbing pad superposed on said medium for becoming stained by released dye, and a liftable tab disposed for covering said rupturable medium and pad.

2. An athletic shoe as set forth in claim 1, said liftable tab forming a part of said inner sole.

* * * * *